US006524160B1

(12) United States Patent
Ismail et al.

(10) Patent No.: US 6,524,160 B1
(45) Date of Patent: Feb. 25, 2003

(54) TOY VEHICLE GEAR SHIELD

(76) Inventors: Steven A. Ismail, 1446 Second St., Red Bluff, CA (US) 96080; David Williams, 1456 Second St., Red Bluff, CA (US) 96080

( * ) Notice: Subject to any disclaimer, the term of this patent is extended or adjusted under 35 U.S.C. 154(b) by 0 days.

(21) Appl. No.: 10/086,827

(22) Filed: Mar. 1, 2002

(51) Int. Cl.[7] ..... A63H 17/14
(52) U.S. Cl. ..... 446/427; 446/424
(58) Field of Search ..... 446/427, 424, 446/431, 465, 462

(56) References Cited

U.S. PATENT DOCUMENTS

| | | | | |
|---|---|---|---|---|
| 3,501,863 A | | 3/1970 | Matsushiro | |
| D252,576 S | | 8/1979 | Frey | |
| 4,306,375 A | | 12/1981 | Goldfarb et al. | |
| 4,443,968 A | | 4/1984 | Law | |
| 4,902,260 A | | 2/1990 | Im | |
| 5,135,428 A | | 8/1992 | Shibayama et al. | |
| 5,173,072 A | * | 12/1992 | Ozawa | 446/462 |
| 6,024,623 A | * | 2/2000 | Menow et al. | 446/15 |
| 6,364,736 B1 | * | 4/2002 | Lee | 446/463 |

* cited by examiner

*Primary Examiner*—Derris H. Banks
*Assistant Examiner*—Ali Abdelwahed

(57) ABSTRACT

A toy vehicle gear shield for protecting the gears of a toy vehicle from debris. The device includes a panel having a top edge, a bottom edge, a first side edge and a second edge. A first flange is attached to and extends along a length of the top edge. The first flange generally lying in a plane orientated perpendicular to a plane of the front side of the panel. A second flange is attached to the second side edge of the panel and has a free edge positioned distal to the panel. A tab is attached to the free edge of the second flange which lies in a plane orientated generally perpendicular to the plane of the panel. The plane of the tab is orientated generally parallel to a plane of the first flange. The tab has a pair of openings therein for receiving fasteners from the toy vehicle.

7 Claims, 2 Drawing Sheets

TOY VEHICLE GEAR SHIELD

BACKGROUND OF THE INVENTION

1. Field of the Invention

The present invention relates to gear protecting devices and more particularly pertains to a new toy vehicle gear shield for protecting the gears of a toy vehicle from debris.

2. Description of the Prior Art

The use of gear protecting devices is known in the prior art. More specifically, gear protecting devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 4,306,375; 5,135,428; 4,902,260; 3,501,863; U.S. Des. Pat. No. 252,576; and U.S. Pat. No. 4,443,968.

While these devices fulfill their respective, particular objectives and requirements, the aforementioned patents do not disclose a new toy vehicle gear shield. The inventive device includes a panel having a front side and a back side, a top edge, a bottom edge, a first side edge and a second edge. A first flange is attached to and extends along a length of the top edge. The first flange generally lying in a plane orientated perpendicular to a plane of the front side of the panel. A second flange is attached to the second side edge of the panel. The second flange has a free edge positioned distal to the panel. A tab is attached to the free edge of the second flange which lies in a plane orientated generally perpendicular to the plane of the panel and extends in generally the same direction as the first flange. The plane of the tab is orientated generally parallel to a plane of the first flange. The tab has a pair of openings therein for receiving fasteners holding a servo mount to a toy vehicle.

In these respects, the toy vehicle gear shield according to the present invention substantially departs from the conventional concepts and designs of the prior art, and in so doing provides an apparatus primarily developed for the purpose of protecting the gears of a toy vehicle from debris.

SUMMARY OF THE INVENTION

In view of the foregoing disadvantages inherent in the known types of gear protecting devices now present in the prior art, the present invention provides a new toy vehicle gear shield construction wherein the same can be utilized for protecting the gears of a toy vehicle from debris.

The general purpose of the present invention, which will be described subsequently in greater detail, is to provide a new toy vehicle gear shield apparatus and method which has many of the advantages of the gear protecting devices mentioned heretofore and many novel features that result in a new toy vehicle gear shield which is not anticipated, rendered obvious, suggested, or even implied by any of the prior art gear protecting devices, either alone or in any combination thereof.

To attain this, the present invention generally comprises a panel having a front side and a back side, a top edge, a bottom edge, a first side edge and a second edge. A first flange is attached to and extends along a length of the top edge. The first flange generally lying in a plane orientated perpendicular to a plane of the front side of the panel. A second flange is attached to the second side edge of the panel. The second flange has a free edge positioned distal to the panel. A tab is attached to the free edge of the second flange which lies in a plane orientated generally perpendicular to the plane of the panel and extends in generally the same direction as the first flange. The plane of the tab is orientated generally parallel to a plane of the first flange. The tab has a pair of openings therein for receiving fasteners holding a servo mount to a toy vehicle.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new toy vehicle gear shield apparatus and method which has many of the advantages of the gear protecting devices mentioned heretofore and many novel features that result in a new toy vehicle gear shield which is not anticipated, rendered obvious, suggested, or even implied by any of the prior art gear protecting devices, either alone or in any combination thereof.

It is another object of the present invention to provide a new toy vehicle gear shield which may be easily and efficiently manufactured and marketed.

It is a further object of the present invention to provide a new toy vehicle gear shield which is of a durable and reliable construction.

An even further object of the present invention is to provide a new toy vehicle gear shield which is susceptible of a low cost of manufacture with regard to both materials and labor, and which accordingly is then susceptible of low prices of sale to the consuming public, thereby making such toy vehicle gear shield economically available to the buying public.

Still yet another object of the present invention is to provide a new toy vehicle gear shield which provides in the apparatuses and methods of the prior art some of the advantages thereof, while simultaneously overcoming some of the disadvantages normally associated therewith.

Still another object of the present invention is to provide a new toy vehicle gear shield for protecting the gears of a toy vehicle from debris.

Yet another object of the present invention is to provide a new toy vehicle gear shield which includes a panel having a front side and a back side, a top edge, a bottom edge, a first side edge and a second edge. A first flange is attached to and extends along a length of the top edge. The first flange generally lying in a plane orientated perpendicular to a plane of the front side of the panel. A second flange is attached to the second side edge of the panel. The second flange has a free edge positioned distal to the panel. A tab is attached to the free edge of the second flange which lies in a plane orientated generally perpendicular to the plane of the panel and extends in generally the same direction as the first flange. The plane of the tab is orientated generally parallel to a plane of the first flange. The tab has a pair of openings therein for receiving fasteners holding a servo mount to a toy vehicle.

Still yet another object of the present invention is to provide a new toy vehicle gear shield that is retrofittable to a plurality of toy vehicles.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
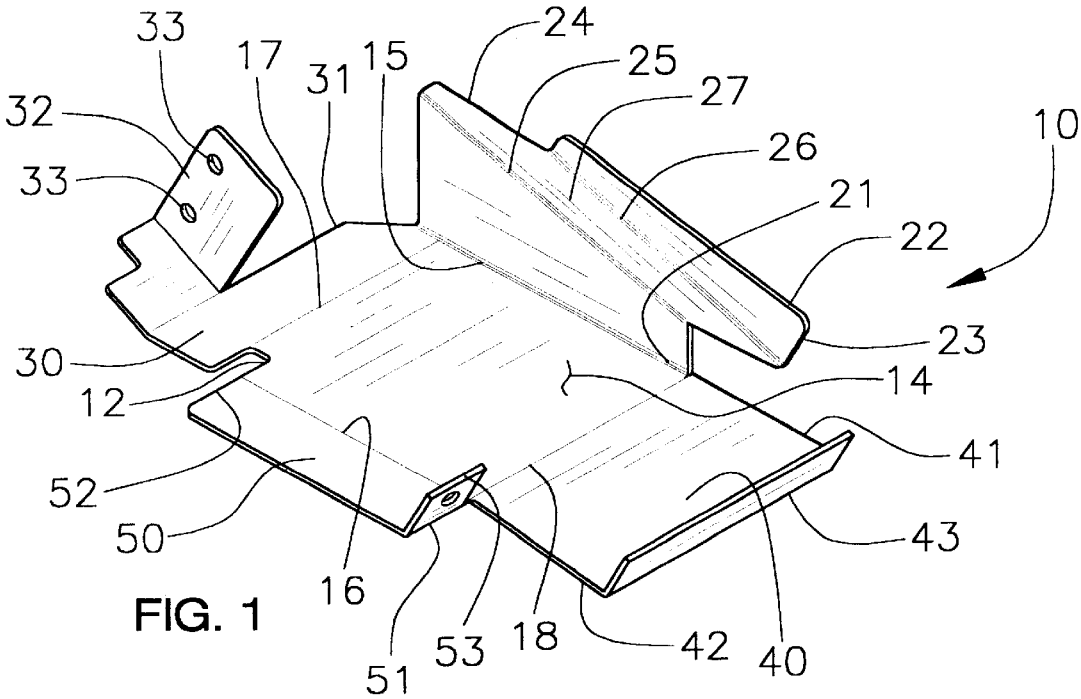
FIG. 1 is a schematic perspective view of a new toy vehicle gear shield according to the present invention.
Figure 2:
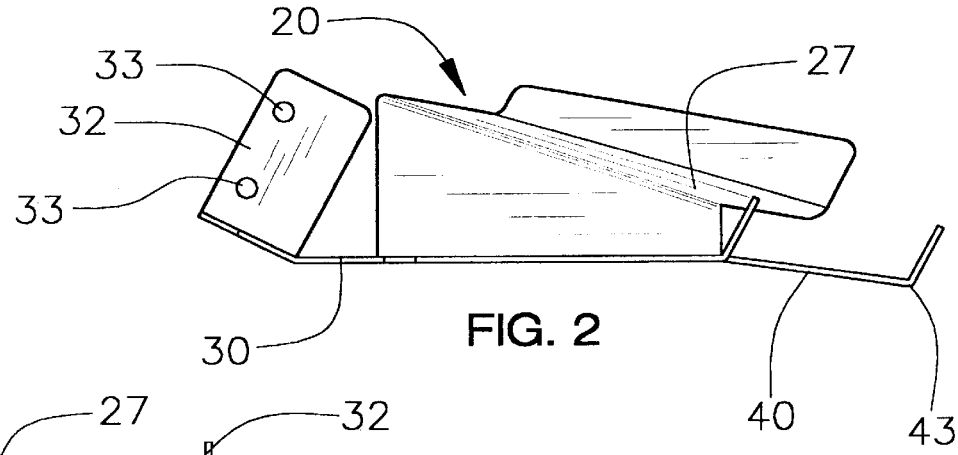
FIG. 2 is a schematic side view of the present invention.
Figure 3:
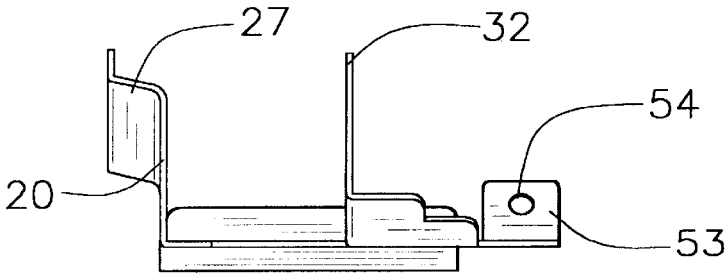
FIG. 3 is a schematic end view of the present invention.
Figure 4:
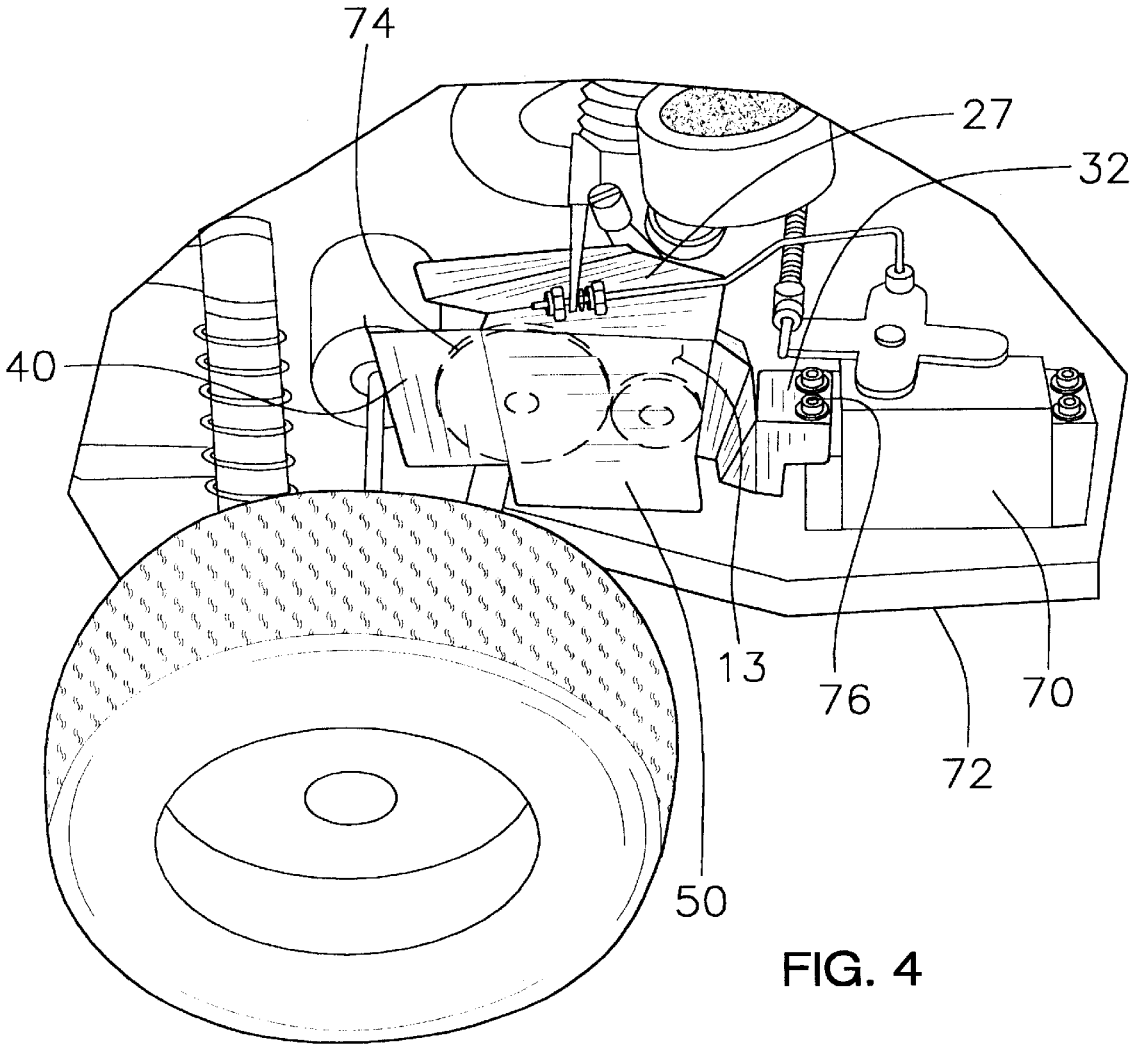
FIG. 4 is a schematic perspective view of the present invention.

With reference now to the drawings, and in particular to FIGS. 1 through 4 thereof, a new toy vehicle gear shield embodying the principles and concepts of the present invention and generally designated by the reference numeral 10 will be described.

As best illustrated in FIGS. 1 through 4, the toy vehicle gear shield 10 includes a device which is removably mountable to the servo mount 70 of a toy vehicle 72 such that the device extends over the gear box 74. The servo mount 70 is attached to the toy vehicle 72 by a pair of fasteners 76.

The device 10 includes a panel 12 having a front side 13 and a back side 14. The panel 12 has a top edge 15, a bottom edge 16, a first side edge 18 and a second side edge 17.

A first flange 20 has a first edge 21, a second edge 22, a third edge 23 and a fourth edge 24 wherein the first edge 21 is opposite of the second edge 22. The first edge 21 is attached to and extends along a length of the top edge 15. The first flange 20 generally lies in a plane orientated perpendicular to a plane of the front side 13 of the panel 12. A first bend 25 in the first flange 20 extends between the third 23 and fourth 24 edges. The first bend 25 is angled with respect to the top edge 15 of the panel 12 such that a distance between the first bend 25 and the first side edge 18 is less than a distance between the first bend 25 and the second side edge 17. A second bend 26 in the first flange 20 extends between the third 23 and fourth 24 edges and is positioned between the first bend 25 and the second edge 22. A middle portion 27 of the first flange 20 is defined between the first 25 and second 26 bends. The middle portion 27 extends upward. A portion of the first flange 20 positioned between the second bend 26 and the second edge 22 is orientated generally perpendicular to the middle portion 27 and extends away from the panel 12.

A second flange 30 is attached to the second side edge 17 of the panel 12. The second flange 30 has a free edge 31 positioned distal to the panel 12. A tab 32 is attached to the free edge 31 of the second flange 30. The tab 32 lies in a plane orientated generally perpendicular to the plane of the panel 12 and extends in generally the same direction as the first flange 20. The plane of the tab 32 is orientated generally parallel to a plane of the first flange 20. The tab 32 has a pair of openings 33 therein for receiving the fasteners 76.

A third flange 40 is attached to and extends along the first side edge 18 of the panel 12. The third flange 40 lies in the plane of the panel 12. The third flange 40 has a top edge 41 and a bottom edge 42 corresponding to the top 15 and bottom 16 edges of the panel 12. The third flange 40 has a bend 43 therein extending between the top 41 and bottom 42 edges such that the third flange 40 has a free edge extending in generally the same direction as the first flange 20.

A fourth flange 50 is attached to and extends along the bottom edge 16 of the panel 12. The fourth flange 50 generally lies in the plane of the panel. The fourth flange 50 has a first side edge 51 and a second side edge 52 corresponding to the first 18 and second 17 side edges of the panel 12. A second tab 53 is attached to the first side edge 51 of the fourth flange 50. The second tab 53 extends in generally the same direction as the first flange 20. The second tab 53 has an aperture 54 therein. Auxiliary fasteners may be extended through the aperture in the second tab 53 for more securely attaching the device to the toy 72.

In use, the device 10 is attached to the toy 72 as stated above. The device shields the gear box 74 of the toy 72 from debris when the toy 72 is being used. The various flanges 20, 30, 40, 50 are positioned to extend over and most fully cover the gears box of the toy vehicle 72.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A gear box debris guard device for a toy vehicle, the device being removably mountable to a servo mount of the toy vehicle such that said device extends over a gear box, the servo mount being attached to the toy vehicle by a pair of fasteners, said device comprising:

a panel having a front side and a back side, said panel having a top edge, a bottom edge, a first side edge and a second side edge;

a first flange having a first edge, a second edge, a third edge and a fourth edge wherein said first edge is opposite of said second edge, said first edge being attached to and extending along a length of said top edge, said first flange lying in a plane orientated perpendicular to a plane of said front side of said panel; and a second flange being attached to said second side edge of said panel, said second flange having a free edge positioned distal to said panel, a tab being attached to said free edge of said second flange, said tab lying in a plane orientated perpendicular to a plane of said panel and extending in a same direction as said first flange, said plane of said tab being orientated parallel to a plane of said first flange, said tab having a pair of openings therein for receiving the fasteners.

2. The gear box debris guard device as in claim 1, wherein a first bend in said first flange extends between said third and fourth edges, said first bend being angled with respect to said top edge of said panel such that a distance between said first bend and said first side edge is less than a distance between said first bend and said second side edge, a second bend in said first flange extending between said third and fourth edges and being positioned between said first bend and said second edge, a middle portion of said first flange being defined between said first and second bends, said middle portion extending upward, a portion of said first flange positioned between said second bend and said second edge being orientated perpendicular to said middle portion and extending away from said panel.

3. The gear box debris guard device as in claim 1, further including a third flange being attached to and extending along said first side edge of said panel, said third flange lying in said plane of said panel.

4. The gear box debris guard device as in claim 3, wherein said third flange has a top edge and a bottom edge corresponding to said top and bottom edges of said panel, said third flange having a bend therein extending between said top and bottom edges such that said third flange has a free edge extending in the same direction as said first flange.

5. The gear box debris guard device as in claim 3, further including a fourth flange being attached to and extending along said bottom edge of said panel, said fourth flange lying in said plane of said panel.

6. The gear box debris guard device as in claim 5, wherein said fourth flange has a first side edge and a second side edge corresponding to said first and second side edges of said panel, a second tab being attached to said first side edge of said fourth flange, said second tab extending in the same direction as said first flange, said second tab having an aperture therein.

7. A gear box debris guard device for a toy vehicle, the device being removably mountable to a servo mount of the toy vehicle such that said device extends over a gear box, the servo mount being attached to the toy vehicle by a pair of fasteners, said device comprising:

a panel having a front side and a back side, said panel having a top edge, a bottom edge, a first side edge and a second side edge;

a first flange having a first edge, a second edge, a third edge and a fourth edge wherein said first edge is opposite of said second edge, said first edge being attached to and extending along a length of said top edge, said first flange lying in a plane orientated perpendicular to a plane of said front side of said panel, a first bend in said first flange extending between said third and fourth edges, said first bend being angled with respect to said top edge of said panel such that a distance between said first bend and said first side edge is less than a distance between said first bend and said second side edge, a second bend in said first flange extending between said third and fourth edges and being positioned between said first bend and said second edge, a middle portion of said first flange being defined between said first and second bends, said middle portion extending upward, a portion of said first flange positioned between said second bend and said second edge being orientated perpendicular to said middle portion and extending away from said panel;

a second flange being attached to said second side edge of said panel, said second flange having a free edge positioned distal to said panel, a tab being attached to said free edge of said second flange, said tab lying in a plane orientated perpendicular to a plane of said panel and extending in a same direction as said first flange, said plane of said tab being orientated parallel to a plane of said first flange, said tab having a pair of openings therein for receiving the fasteners;

a third flange being attached to and extending along said first side edge of said panel, said third flange lying in said plane of said panel, said third flange having a top edge and a bottom edge corresponding to said top and bottom edges of said panel, said third flange having a bend therein extending between said top and bottom edges such that said third flange has a free edge extending in a same direction as said first flange; and a fourth flange being attached to and extending along said bottom edge of said panel, said fourth flange lying in said plane of said panel, said fourth flange having a first side edge and a second side edge corresponding to said first and second side edges of said panel, a second tab being attached to said first side edge of said fourth flange, said second tab extending in the same direction as said first flange, said second tab having an aperture therein.

* * * * *